United States Patent [19]

Köhler et al.

[11] 4,325,342

[45] Apr. 20, 1982

[54] FUEL INJECTION PUMP CONTROL FOR INTERNAL COMBUSTION ENGINES, ESPECIALLY DIESEL ENGINES

[75] Inventors: Wolfgang Köhler; Karl E. Hafner, both of Cologne, Fed. Rep. of Germany

[73] Assignee: Klöckner-Humboldt-Deutz Aktiengesellschaft, Cologne, Fed. Rep. of Germany

[21] Appl. No.: 86,257

[22] Filed: Oct. 18, 1979

[30] Foreign Application Priority Data

Oct. 20, 1978 [DE] Fed. Rep. of Germany ..... 2845659

[51] Int. Cl.[3] ..... F02M 59/20

[52] U.S. Cl. ..... 123/504

[58] Field of Search ..... 123/504, 500, 501, 503

[56] References Cited

U.S. PATENT DOCUMENTS

| | | | |
|---|---|---|---|
| 1,706,011 | 3/1929 | Whaley | 123/504 |
| 1,824,467 | 9/1931 | Darby et al. | 123/504 |
| 1,862,132 | 6/1932 | Adams | 123/504 |
| 1,960,359 | 5/1934 | Vincent | 123/504 |
| 1,983,351 | 12/1934 | Edwards | 123/504 |
| 2,090,428 | 8/1937 | Schneider | 123/504 |
| 2,436,079 | 2/1948 | Shipp | 123/504 |

FOREIGN PATENT DOCUMENTS

| | | | |
|---|---|---|---|
| 2016078 | 9/1979 | United Kingdom | 123/504 |

*Primary Examiner*—Charles J. Myhre
*Assistant Examiner*—Magdalen Moy
*Attorney, Agent, or Firm*—Becker & Becker, Inc.

[57] ABSTRACT

A fuel injection pump control for internal combustion engines including a pump piston which pump piston is actuatable by a shaft and a cam follower roller adapted to contact the pertaining cam of the camshaft, whereby the fuel delivery volume can be adjusted by varying the effective delivery stroke. The shaft is pivotally connected to the pump piston; the longitudinal central axis of the pump piston is arranged in the plane of rotation of the cam and eccentrically to the camshaft axis; and, coaxial to the axis of rotation of the cam follower roller and/or at the end of the shaft, there is connected to the shaft a rocking lever the free end of which is adjustable within a predetermined area, preferably a triangular area.

9 Claims, 7 Drawing Figures

FUEL INJECTION PUMP CONTROL FOR INTERNAL COMBUSTION ENGINES, ESPECIALLY DIESEL ENGINES

The present invention relates to a fuel injection pump control for internal combustion engines, particularly for Diesel engines, having a pump piston which is actuated so that the fuel delivery volume is controllable by varying the effective delivery stroke of the pump piston.

Recently a fuel injection system has become known with a fuel injection pump mechanically driven by the engine, particularly one of the conventional type having an injection conduit and an injection valve. In this known system, injection pumps are suggested which allow injection independent of the number of revolutions of the engine whereby the injections are in conformity with a predetermined revolution-dependent delivery commencement adjustment.

By this it is achieved that the injection pressure is held constant over a wide range of number of revolutions. The proposal provides suitable drive means or transmission means with various kinematic components.

It is an object of the present invention to propose control ranges for pump transmission arrangements for controlling injection pump systems so that, on the one hand, a relatively wide range of number of revolutions is covered, over which range the pump piston velocity of the injection pump is maintained at least nearly constant; and, on the other hand, a sensible change in direction and amount of the delivery commencement within this range of number of revolutions can be carried out.

These objects and other objects and advantages of the invention will appear more clearly from the following specification in connection with the accompanying drawings, in which.

Figure 1:
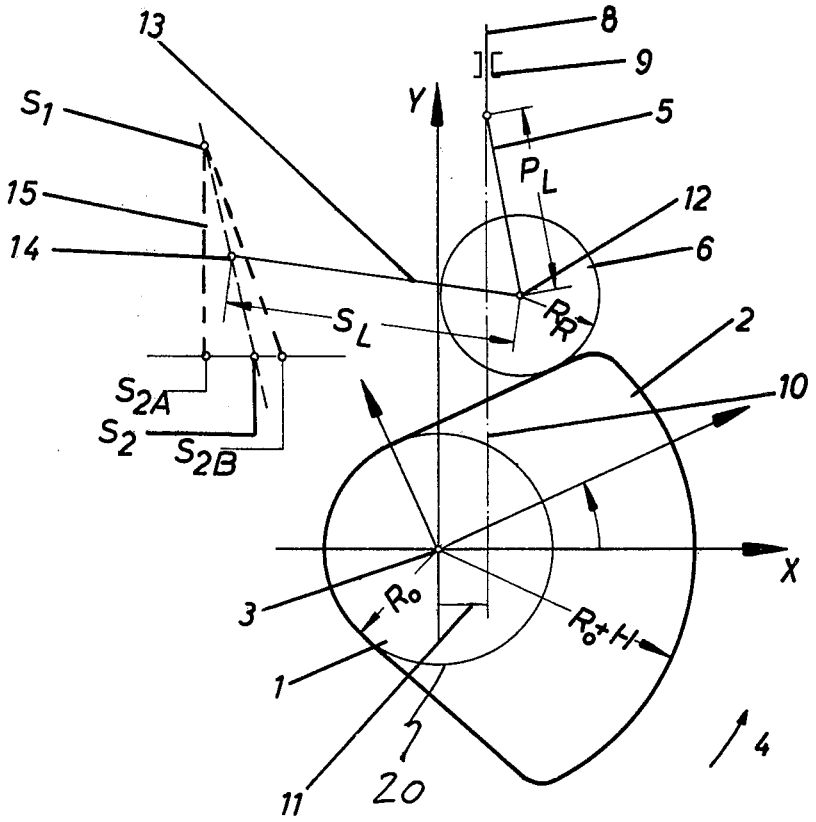
FIG. 1 is a diagrammatic view of a fuel injection pump drive arrangement in accordance with one embodiment of the invention.

The present invention is characterized primarily therein that the pump piston is connected to a shaft or shaft means carrying a cam follower roller, whereby this shaft is pivotally connected to the pump piston. The invention is further characterized therein that the longitudinal central axis of the pump piston is arranged in the plane of rotation of the cam and is arranged eccentrically in relation to the camshaft axis. Furthermore, the invention is characterized therein that in the axis of rotation of the cam follower roller and/or at the cam follower roller carrying shaft there is operatively connected, so as to be movable or pivotable, a lever or rocking lever, the free end of which is adjustable within a defined area.

The invention makes use of the realization that it is sufficient that the free end of the rocking lever is moved or adjusted in a plane of rotation perpendicular to the axis of rotation of the camshaft and in a generally parallel direction to the pump piston axis so as to vary the velocity of the pump piston and, accordingly, the delivery velocity. Furthermore, movement of the free end of the rocking lever generally perpendicular to this plane is sufficient to carry out the number of revolution-dependent delivery commencement adjustments. For the shape of the control range of the free end of the rocking lever approximately the shape of a planar triangle results. This shape is particularly then attained when with an increasing number of revolutions of the engine also the delivery commencement or initiation adjustment is continuously carried out. A further advantage obtained by the present invention resides therein that the free end of the rocking lever is movable on a curve from a point at low number of revolutions to a point of high number of revolutions, whereby the curve can be such that the delivery commencement adjustment is approximately linear over the length of arc of the curve. A curve which is suited for this is approximately of a circular arc.

In order to describe the control area definitely, a mutually perpendicularly arranged pair of x and y axes was arranged to have its point of intersection, or zero point, coincide with the axis of rotation, in the plane of rotation, of the cam or when viewed in cross section of the camshaft. On the basis of this coordinate system, one embodiment provides that a point $S_1$ of the triangular adjustment area is away from the zero point at a predetermined distance which is less than the length $RS_1$, where $RS_1$ is made up of $S_L+R_R+R_O$, where $S_L=$ the length of the rocking lever, $R_R=$ the radius of the cam follower roller, and $R_O=$ the radius of the cam base circle of the cam. This point $S_1$ thereby represents the starting point of the adjustment at a low number of revolutions.

In a further embodiment of the invention, the point $S_1$ is located in such a way that it is arranged at a distance from the zero point of the coordinate system which by a distance of length DRS is less than the radius $RS_1$, where the length of DRS is dependent on the maximal permissible Hertzian compression between the cam follower roller and the cam.

In order to maintain the injection pressure constant over a range of number of revolutions of the engine, the free end of the rocking lever must be moved from point $S_1$ to a point $S_2$ whereby the latter is on a line parallel to the x axis at a distance on the y axis in the range of $YS_2=R_O+R_R+H/2$, where H corresponds to the distance from the circumference of the base circle to the highest point of the cam. The parallel line, at the same time, represents the base of the triangular adjustment area.

Investigations have shown that the coordinate value on the x axis of the point $S_1$ and the corresponding value of point $S_2$ are nearly identical. It has been shown hereby that most favorable results are achieved when the x-values for the two points are negative by counterclockwise rotation. As a second geometrical locus of point $S_1$ it is further proposed that this point $S_1$ is on the line (Fahrstrahl) through the zero point of the coordinate system at an angle of $\phi 1$ (phi) to the positive y-axis, whereby the angle $\phi 1$ is determined in such a way that the mean injection velocity, when the free end of the rocking lever is in point $S_2$, attains a predetermined value, which value is in conformity with the pertaining characteristics of the internal combustion engine.

When in point $S_2$, which must be adjusted at high number of revolutions of the internal combustion engines for the fuel injection pump, a delivery commencement adjustment relative to the delivery commencement in position $S_1$ will be necessary. In accordance with the invention, it will only be necessary to move the free end of the rocking lever on the line parallel to the x-axis through the point $S_2$. Thereby with a shifting of the point $S_2$ in the direction towards the lower x-axis values, a delivery commencement adjustment in the direction "late" is attained, while a shifting or adjustment to the greater x-values provides a movement or shifting of the delivery commencement at earlier points in time. For this, it has been shown that the length of the base side of the triangle in relation to the length of the other two sides is relatively small, preferably in the range of 1:3 to 1:5. By this shifting or adjustment of the free end of the rocking lever, it is possible to do without the conventional timing gear which normally works with fly weights, which timing gear is liable to disruptions in operation.

In a further embodiment of the invention, it is proposed to limit the eccentricity of the longitudinal axis of the pump piston relative to the camshaft axis in such a way that approximately the same lift end-position of the pump piston for the point $S_1$ and all points $S_2$ on the base side of the triangle is present.

Referring now particularly to the drawings, the transmission or drive arrangement for a high-pressure injection pump comprises a camshaft having a cam 2, which camshaft rotates about axis or center 3 as indicated by the arrow 4, i.e. in counterclockwise direction. A cam follower roller 6 contacts the cam 2 which roller 6 moves the pump piston 8 by intervention of a pivotally arranged shaft or shaft means designated by numeral 5. The shaft 5 is pivotally connected to pump piston 8 with an end and the other end of shaft 5 is pivotally connectible and coaxial to the cam follower roller 6.

The pump piston 8 is arranged in a pump cylinder 9, whereby the longitudinal central axis 10 of pump piston 8 is a distance 11 away from the line perpendicular to the horizontal axis of center 3 of camshaft 1. The axis of rotation 12 of the cam follower roller 6 is coaxial to one end of a rocking lever 13 which is provided with a link 14 at its other end. Parameters of the just described arrangement are the length of distance $P_L$ of the shaft 5, length of the distance $S_L$ of the rocking lever 13, distance 11, radius $R_R$ of the cam follower roller 6, the radius $R_O$ of the cam base circle 20 of the cam 2, and the height H of the cam, i.e. the distance between the circumference of the cam base circle 20 and the greatest distance of the cam from the axis or center 3.

The control range of link 14 is outlined by a curve combining the points $S_1$, $S_{2A}$ and $S_{2B}$.

Figure 2:
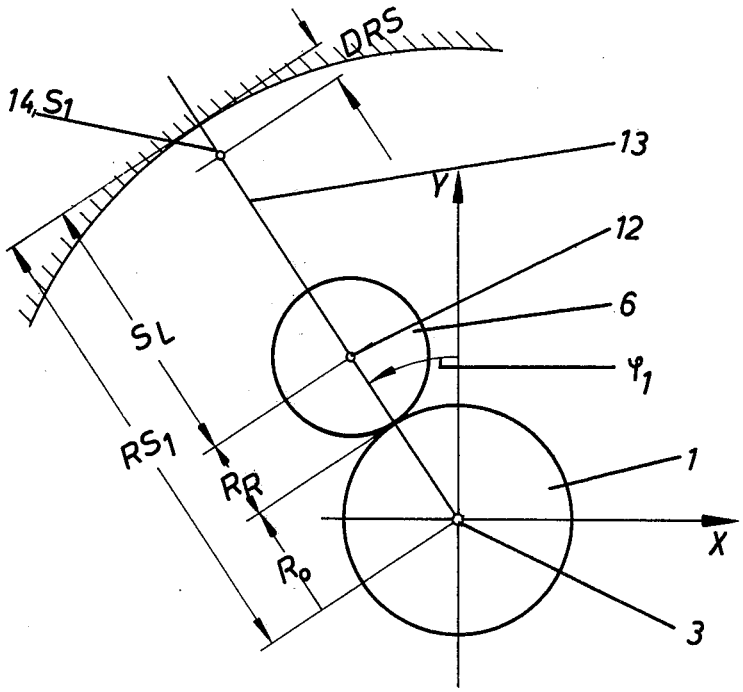
FIG. 2 is a diagrammatic view similar to FIG. 1 for determining the location of the free end of a lever at a low number of revolutions.
Figure 3:
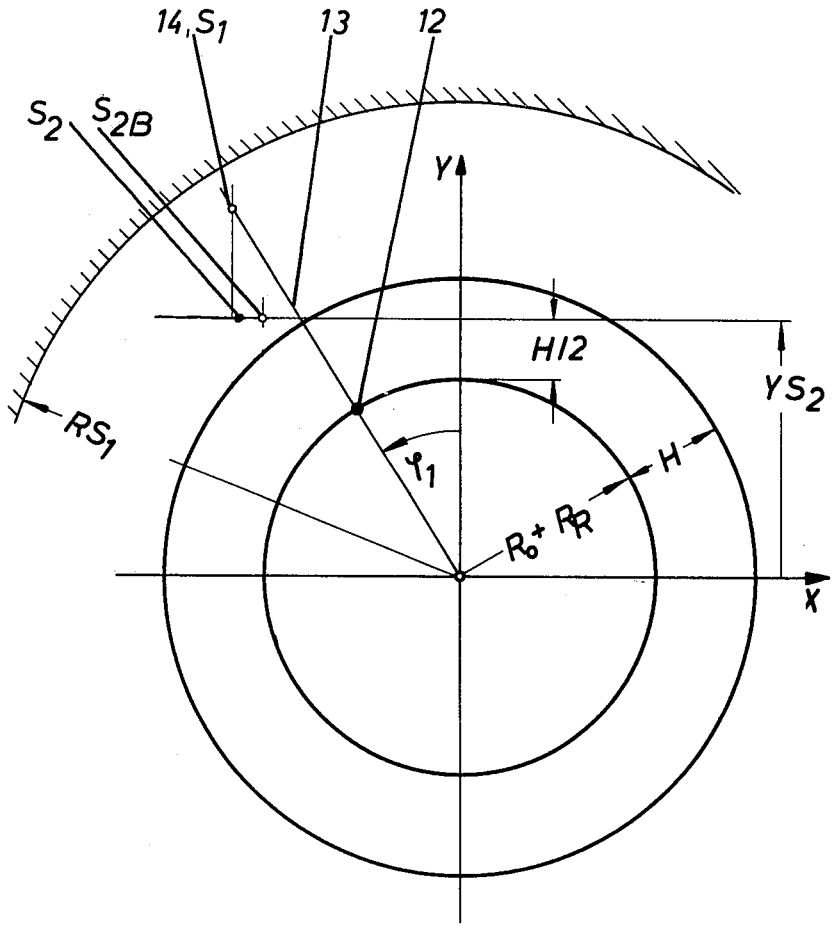
FIG. 3 is a diagrammatic view similar to FIG. 2 for determining the location of the end of the rocking lever at a high number of revolutions.

In order to better describe the optimal adjustment range 15 of the pump drive arrangement, in the axis of rotation 3 of the camshaft 1 a mutually perpendicular coordinate system with an x-axis and y-axis was located with its center. With reference to FIGS. 2 and 3, next is explained how the upper point $S_1$ and the base side of the triangle, which delimits the adjustment area 15, is obtained. A geometric locus for determining the point $S_1$ is thereby obtained that about the axis 3 of camshaft 1 there is prescribed a circle having the radius $RS_1$ whereby the length of the radius $RS_1$ is equal to the sum of: length $S_L$, this being the length of the rocking lever 13, length of radius $R_R$ of the cam follower roller 6, and length of radius $R_O$ of the base circle 20 of the cam 2.

In FIG. 2, there is shown a segment or portion of this circle. When point $S_1$ is outside of this circle, the cam follower roller 6 would not contact the base circle 20. This would reduce the functional capability of the fuel injection system. Since tests have shown that an arrangement of point $S_1$ on this circle provides for too great an acceleration of the components of the fuel injection pump and too great a Hertzian compression between the cam follower roller 6 and the cam 2, the point $S_1$ is preferably arranged on the circle having a radius $RS_1$-DRS about the center 3 of the coordinate system. The magnitude of DRS depends thereby on the possible stress, or capacity to withstand load, of the components and on the maximal permissible Hertzian compression the magnitude of DRS should be as small as possible.

The second geometric locus for determining the position of the point $S_1$ is a line (Fahrstrahl) extending from the center 3 of the coordinate system at an angle of $\phi l$ between the positive portion of the y-axis in the second quadrant. The magnitude of the angle $\phi l$ is dependent upon the required mean injection velocity at high number of revolutions, i.e. in point $S_2$. Generally, ti can be stated that the injection velocity is that much smaller the smaller the angle $\phi l$ will be. Thus, two limits for the location of point $S_1$ are determined, namely, one on the circle with the radius $RS_1$-DRS and, secondly, on the line which intersects the positive y-axis or the angle $\phi l$.

In order to determine the point $S_2$, this representing a possible position of the free end of the rocking lever 13 at high number of revolutions and at the desired delivery commencement adjustment, a parallel is drawn to the x-axis, perpendicular to the y-axis at $YS_2$, whereby $YS_2 = R_O + R_R + H/2$, where $R_O$, $R_R$, and H/2 have the above identified meaning.

The length of this base side of the triangle or control area is a function of the desired delivery commencement control range, which customarily is of the order of 0° to 6° of camshaft rotation angle.

It is to be observed hereby that the aforementioned point $S_2$ is only one point of the line which delimits the adjustment area 15. The point $S_2$ in this example has nearly an equal x-axis value as point $S_1$. This means that by movement of the rocking lever end from point $S_1$ to point $S_2$, the number of revolutions increases from a lower number to the highest number of revolutions, whereby at the highest number of revolutions, the required mean injection velocity is obtained and the desired delivery commencement adjustment in relation to point $S_1$ is relatively small.

Figure 4:
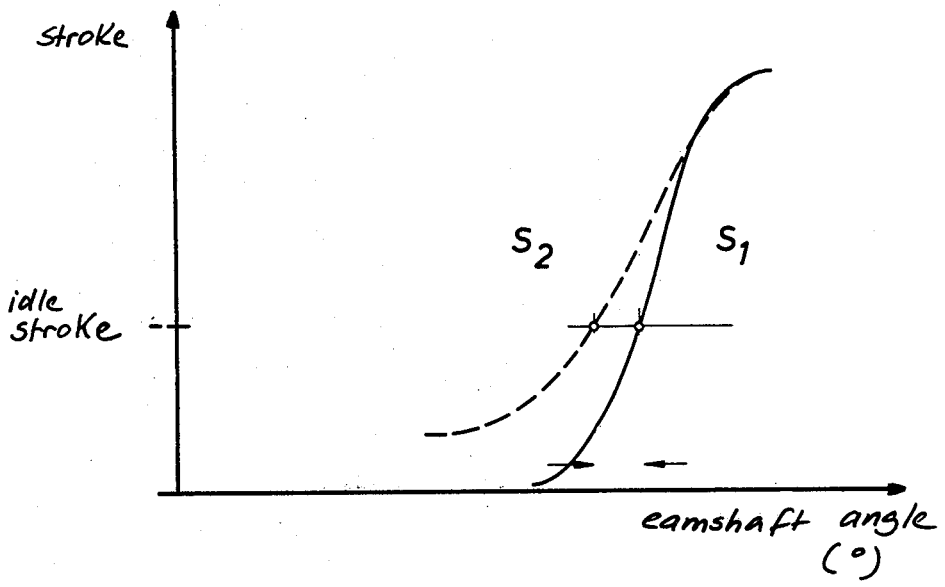
FIG. 4 is a graph indicating the relationship between the pump piston stroke in relation to the camshaft angle for determining the attitude of the free end of the rocking lever at a low number of revolutions and at a high number of revolutions.

The representation of FIG. 4 is obtained when the piston lift or stroke is related to the cam angle and when the free end of the rocking lever 13 is once in point $S_1$ (solid line) and next in the point $S_2$ (dash line). Subsequently, the size of the idle lift, which is resulting as a line parallel to the x-axis in FIG. 4, is introduced. The intersection of this parallel line with the two lift curves provides the delivery commencement adjustment at the transition of the operational position $S_1$ into the position $S_2$.

The length of the base side and, thereby, the corner points or apexes, $S_{2A}$ and $S_{2B}$ of the triangle are defined by providing beforehand a delivery commencement adjust range or zone.

Figure 5:
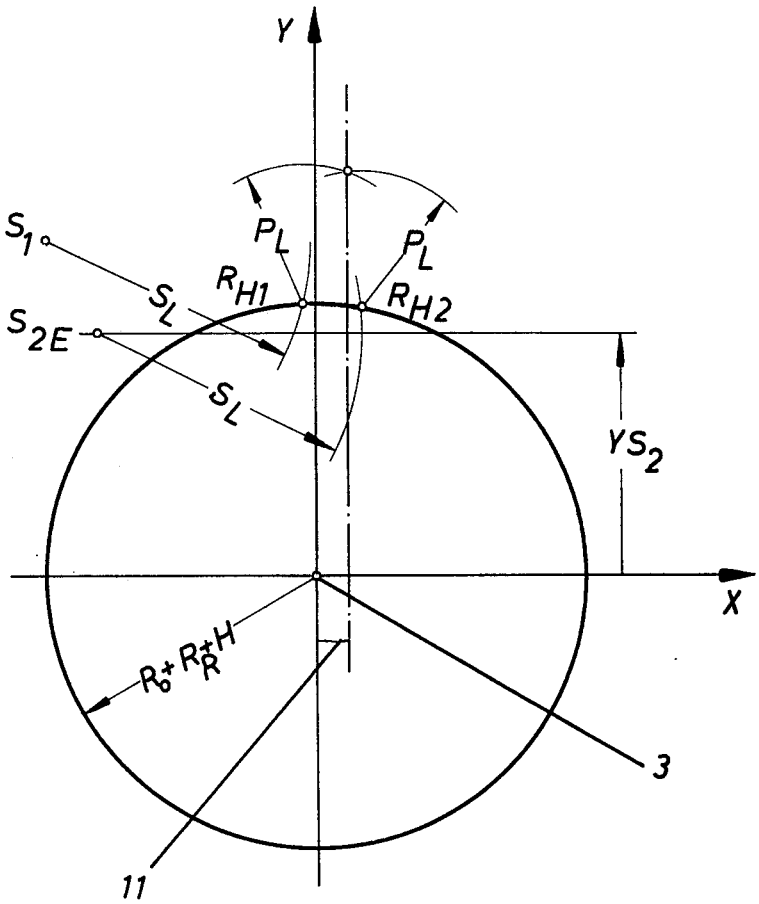
FIG. 5 is a diagrammatic view similar to FIG. 2 indicating determination of the eccentricity of the pump piston axis in relation to the camshaft axis; and FIGS. *6a* and *6b* indicate in graphical representation the progress of the piston end stroke and the piston velocities for various positions of the free end of the lever.

FIG. 5 shows how the distance of eccentricity 11 of the pump piston axis 10 to the axis of rotation 3 of camshaft 2 is determined. For this, the requirement has to be observed that the piston-stroke-end of the pump piston, in all possible positions of the link 14, is always the same. In order to obtain this distance 11, first about the zero point of the coordinate axes, i.e. about the axis 3 of the shaft 1, a circle with a radius is prescribed which radius is equal to $R_O+R_R+H$. Subsequently about the upper corner point $S_1$ of the triangle a circle with radius $S_L$ is prescribed where $S_L$ corresponds to the length of lever 13. This circle intersects the circle having the radius $R_O+R_R+H$, where $R_O$, $R_R$, and H have the foregoing meaning. Similarly, about the point $S_{2E}$, which is arranged near the center between the two points $S_{2A}$ and $S_{2B}$ on the base side of the triangle, the circle with the radius $S_L$ is prescribed. This circle intersects the circle about the zero point in point $R_{2H}$. Subsequent to this about the point $R_{1H}$ and $R_{2H}$ a circle with the radius $P_L$ is prescribed which radius corresponds to the length of the shaft or shaft means 5. The intersection of these two circles provides the x-value for the position of the longitudinal axis of the pump piston. The longitudinal axis of the pump piston proper is attained by drawing a line parallel to the y-axis through this point.

Figure 6A:
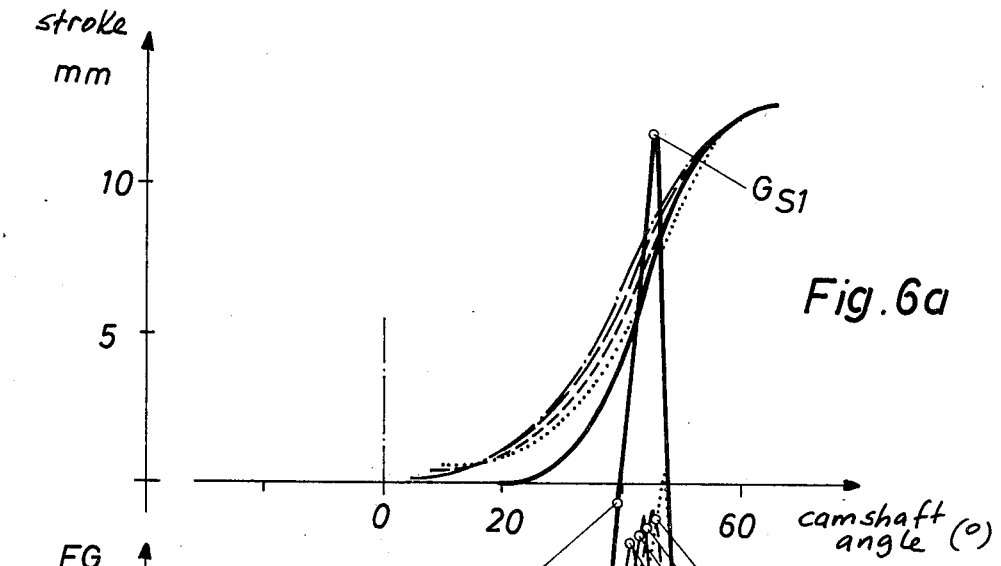

Referring to the graph of FIG. 6*a*, the pump stroke units are indicated on the y-axis, and the camshaft angle is indicated on the x-axis. The curves indicate the progress of the pump stroke for various positions of link 14 of the rocking lever 13. The solid curve is obtained when the link 14 is arranged at point $S_1$. The other curves are obtained when the link 14 is at various points on the base of the triangle, i.e. between the points $S_{2A}$ and $S_{2B}$. As indicated in the graph, the end position of the piston is in all positions of the same height.

Figure 6B:
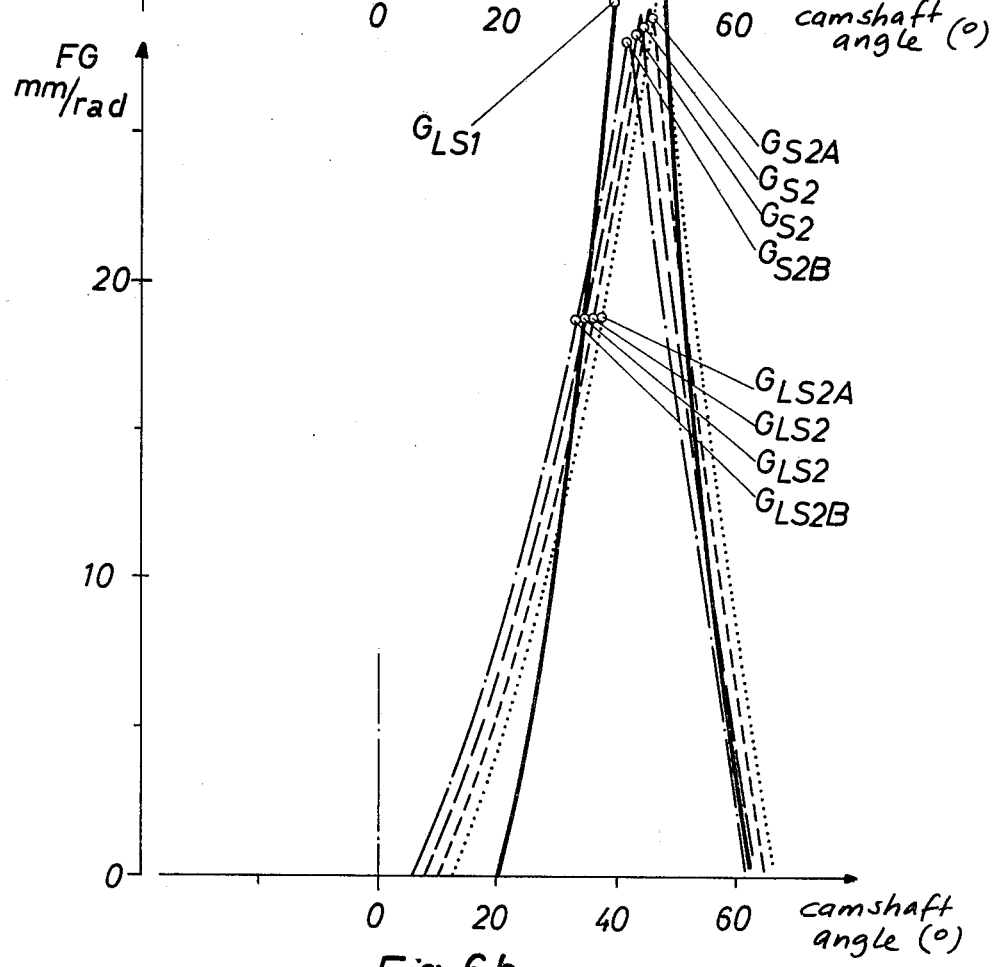

With respect to the lower curves (FIG. 6*b*) the delivery velocity (F G) is indicated on the y-axis, and the x-axis again indicates camshaft angles. The adjustment points of the link 14 for the curves shown are identical for the positions for determining the curves of the upper graph. This representation indicates that the ratio of the mean delivery velocity for low and high revolutions is practically unchanged. The velocity at low revolutions—idle stroke of the piston pump—is indicated by $G_L$ with the index digit of the position of link 14. The velocity at the end of the delivery stroke is designated by G with the index digit of the measuring point. Furthermore, it is indicated that the delivery commencement adjustment in the range of angles is variable, which range is also covered by a conventional timing gear. Furthermore, the diagram indicates very clearly that the injection adjustment does not affect the delivery velocity during idle stroke, and at the delivery termination, or end, has nearly no effect.

When the pertaining injection pump is controlled within the limits suggested by the present invention, an injection system is obtained in which over a wide range of number of revolutions the injection pressure can be maintained constant, which injection pressure would only be realized at the rated number of revolutions by a conventional pump, for example between the rated number of revolutions of the engine and the number of revolutions at maximum engine torque. The number of revolution-dependent adjustment can also be carried out in such a way that the pressure decreases with increasing number of revolutions, but to a lesser extent than is the case with conventional pumps. Equally, a delivery commencement adjustment does not entail change of the pump piston velocity and, thus, the injection pressure. By means of the control range or area in accordance with the present invention, it is furthermore superfluous to use the timing gear or injection timing means.

The present invention is, of course, in no way restricted to the specific disclosure of the specification and drawings, but also encompasses any modifications within the scope of the appended claims.

What we claim is:

1. A fuel injection pump control for internal combustion engines having a camshaft, comprising in combination:

a cam mounted on said camshaft, said cam having a base circle;

a pump piston actuatable in response to the motion of said cam so that the fuel delivery volume is controlled by varying the effective stroke of said pump piston, with the longitudinal central axis of said pump piston being arranged in the plane of rotation of said cam and removed eccentrically a predetermined distance from that perpendicular line in said plane which passes through the axis of rotation of said camshaft;

a cam follower roller, said roller being movable in response to rotation of said cam when in contact therewith;

shaft means for rotatably mounting said cam follower roller with one end thereof and the other end being pivotally connected to said pump piston; and a lever having a first end operatively connectible to at least one of the group consisting of said cam follower roller and said shaft means, said lever also having a second end which is adapted to be adjustably positioned only within a predetermined area, said predetermined area having substantially the shape of a planar triangle.

2. A fuel injection pump control in combination according to claim 1, wherein one coordinate system point of said planar triangle is positioned within a circle in said plane of rotation of said cam and about the central axis of said camshaft, said circle having a radius $RS_L=S_L+R_R+R_O$, where:

$S_L$= the length of said lever;

$R_O$= the radius of said base circle of said cam; and $R_R$= the radius of said cam follower roller.

3. A fuel injection pump control for internal combustion engines having a camshaft, comprising:

a cam mounted on said camshaft, said cam having a base circle;

a pump piston actuatable in response to the motion of said cam so that the fuel delivery volume is controlled by varying the effective stroke of said pump piston, with the longitudinal central axis of said pump piston being arranged in the plane of rotation of said cam and removed a predetermined distance from that perpendicular line in said plane which passes through the axis of rotation of said camshaft;

a cam follower roller, said roller being movable in response to rotation of said cam when in contact therewith;

shaft means for rotatably mounting said cam follower roller with one end thereof and the other end being pivotally connected to said pump piston; and a lever having a first end operatively connectible to at least one of the group consisting of said cam follower roller and said shaft means, said lever also having a second end which is adapted to be positioned within a predetermined area shaped in a planar triangle;

one point of said triangle being positioned within a circle in said plane of rotation of said cam and about the central axis of said camshaft, said circle having a radius $RS_L = S_L + R_R + R_O$, where:

$S_L$ = the length of said lever, $R_O$ = the radius of said base circle of said cam; and $R_R$ = the radius of said cam follower roller, said point being arranged on that circle about the central axis of said camshaft having a radius of $RS_1$-DRS, where DRS is a length of distance in conformity with the maximal permissible acceleration of fuel injection pump components and the maximal permissible Hertzian compression between said cam follower roller and said cam.

4. A fuel injection pump control according to claim 3, wherein the height of said apex from the pertaining base side is substantially greater than the length of the pertaining base of said triangle.

5. A fuel injection pump control for internal combustion engines having a camshaft, comprising:

a cam mounted on said camshaft, said cam having a base circle;

a pump piston actuatable in response to the motion of said cam so that the fuel delivery volume is controlled by varying the effective stroke of said pump piston, with the longitudinal central axis of said pump piston being arranged in the plane of rotation of said cam and removed a predetermined distance from that perpendicular line in said plane which passes through the axis of rotation of said camshaft;

a cam follower roller, said roller being movable in response to rotation of said cam when in contact therewith;

shaft means for rotatably mounting said cam follower roller with one end thereof and the other end being pivotally connected to said pump piston; and a lever having a first end operatively connectible to at least one of the group consisting of said cam follower roller and said shaft means, said lever also having a second end which is adapted to be positioned within a predetermined area.

said predetermined area having the shape of a planar triangle, the base side of said triangle being parallel to the x-axis of the mutually perpendicular and intersecting x and y axes intersecting at the center of said camshaft and in said plane of rotation, with the y-component of said base side corresponding approximately to $YS_2 = R_O + R_R + H/2$ where:

$R_O$ = the radius of said base circle of said cam;

$R_R$ = the radius of said cam follower roller; and

H = the distance from the circumference of said base circle to the highest point of said cam.

6. A fuel injection pump control according to claim 5, wherein a point $S_2$ on said base side has an x-component corresponding approximately to the x-component of the oppositely located apex for said base side.

7. A fuel injection pump control according to claim 6, wherein said apex is located on a line through said center of said camshaft in said plane of rotation, said line embracing a predetermined angle with the positive part of said y-axis, said predetermined angle being determined in such a way that the mean injection velocity attains a predetermined value at the point $S_2$.

8. A fuel injection pump control for internal combustion engines having a camshaft, comprising:

a cam mounted on said camshaft, said cam having a base circle;

a pump piston actuatable in response to the motion of said cam so that the fuel delivery volume is controlled by varying the effective stroke of said pump piston, with the longitudinal central axis of said pump piston being arranged in the plane of rotation of said cam and removed a predetermined distance from that perpendicular line in said plane which passes through the axis of rotation of said camshaft;

a cam follower roller, said roller being movable in response to rotation of said cam when in contact therewith;

shaft means for rotatably mounting said cam follower roller with one end thereof and the other end being pivotally connected to said pump piston; and a lever having a first end operatively connectible to at least one of the group consisting of said cam follower roller and said shaft means, said lever also having a second end which is adapted to be positioned within a predetermined area, said predetermined area having the shape of a planar triangle, the base side of said triangle having a length in conformity with the magnitude of the pertaining delivery commencement adjustment angle of said lever.

9. A fuel injection pump control for internal combustion engines having a camshaft, comprising:

a cam mounted on said camshaft, said cam having a base circle;

a pump piston actuatable in response to the motion of said cam so that the fuel delivery volume is controlled by varying the effective stroke of said pump piston, with the longitudinal central axis of said pump piston being arranged in the plane of rotation of said cam and removed a predetermined distance from that perpendicular line in said plane which passes through the axis of rotation of said camshaft;

a cam follower roller, said roller being movable in response to rotation of said cam when in contact therewith;

shaft means for rotatably mounting said cam follower roller with one end thereof and the other end being pivotally connected to said pump piston; and a lever having a first end operatively connectible to at least one of the group consisting of said cam follower roller and said shaft means, said lever also having a second end which is adapted to be positioned within a predetermined area shaped in a planar triangle, one point of said triangle being positioned within a circle in said plane of rotation of said cam and about the central axis of said camshaft, said circle having a radius $RS_L = S_L + R_R + R_O$, where:

$S_L$ = the length of said lever, $R_O$ = the radius of said base circle of said cam; and $R_R$ = the radius of said cam follower roller, said predetermined distance of said longitudinal central axis of said pump piston from said perpendicular line being a function of the at least nearly constant lift end-position of said pump piston when said second end of said lever is arranged in conformity with said point and all those points located on the pertaining oppositely located base side between the two apex points thereof.

* * * * *